US006725549B2

(12) United States Patent
Jebe et al.

(10) Patent No.: US 6,725,549 B2
(45) Date of Patent: Apr. 27, 2004

(54) SLIDING SHARPENING DEVICE FOR PENCIL WITH NON-CIRCULAR CROSS SECTION

(75) Inventors: Arnim B. Jebe, Weston, CT (US); Joseph A. Naim, Danbury, CT (US)

(73) Assignee: System K, Inc., Ridgefield, CT (US)

( * ) Notice: Subject to any disclaimer, the term of this patent is extended or adjusted under 35 U.S.C. 154(b) by 0 days.

(21) Appl. No.: 10/242,164

(22) Filed: Sep. 11, 2002

(65) Prior Publication Data

US 2003/0150121 A1 Aug. 14, 2003

(Under 37 CFR 1.47)

Related U.S. Application Data

(60) Provisional application No. 60/355,937, filed on Feb. 11, 2002.

(51) Int. Cl.[7] ..... B43L 23/06

(52) U.S. Cl. ..... 30/452; 30/456; 144/28.11

(58) Field of Search ..... 30/452, 456, 451, 30/457, 462; 144/28.1, 28.11, 28.2, 28.3; 269/1; 83/857, 856, 707

(56) References Cited

U.S. PATENT DOCUMENTS

| | | | | |
|---|---|---|---|---|
| 458,654 A | * | 9/1891 | Brookbank | 30/452 |
| 547,151 A | * | 10/1895 | Moseley | 144/28.1 |
| 2,713,849 A | * | 7/1955 | Consentino | 144/28.1 |
| 2,982,253 A | | 5/1961 | Herbold | |
| 3,851,687 A | | 12/1974 | Jones | |
| 4,759,129 A | | 7/1988 | Alpha | |
| 4,918,816 A | | 4/1990 | Alpha | |
| 4,961,451 A | | 10/1990 | Bucci | |
| 5,077,903 A | | 1/1992 | Kreim | |
| 6,279,238 B1 | * | 8/2001 | Gillson | 30/456 |
| 6,338,198 B1 | | 1/2002 | Rolls | |

FOREIGN PATENT DOCUMENTS

| | | | |
|---|---|---|---|
| FR | 354728 | * | 10/1905 |
| FR | 2558417 | * | 7/1985 |

* cited by examiner

*Primary Examiner*—Stephen Choi
(74) *Attorney, Agent, or Firm*—McCormick, Paulding & Huber LLP

(57) ABSTRACT

A sharpener for a carpenter's pencil that creates a profile shape desired by carpenters rather than a conical point. One end of the sharpener creates a sharpened profile on the narrow side of the pencil, while the opposite end of the sharpener creates a sharpened profile on the wide side when the pencil is rotated 90° about its axis. The pencil is slid laterally back and forth in a guide member, advancing along its axis as material is removed from the narrow side by fixed blades shaving material at an angle. The pencil is then rotated 90° and inserted in the other guide and moved back and forth advancing along its axis as material is removed from the wide side by fixed blades in a similar manner.

5 Claims, 5 Drawing Sheets

SLIDING SHARPENING DEVICE FOR PENCIL WITH NON-CIRCULAR CROSS SECTION

CROSS REFERENCE TO RELATED APPLICATIONS

This application claims the benefits of prior filed, co-pending provisional patent application Serial No. 60/355,937 filed Feb. 11, 2002.

BACKGROUND OF THE INVENTION

This invention relates to sharpening device, and more particularly to a sharpening device for an elongated object with non-circular cross section, such as a carpenter's pencil.

Most pencil sharpening devices currently in use are designed for making round tapered points on pencils having cross-sections, which are either circular or in the shape of a regular polygon, generally hexagonal. This typical geometry, such as round or hexagonal, is not compatible with the rectangular lead pencils used by many professionals, including the well-known carpenter's pencil. It is desirable that carpenter's pencils be sharpened to create a selected profile rather than a point. The wooden sheath around the pencil lead is also non-circular, e.g., rectangular, with narrow edges and wide edges oriented at right angles to one another.

Existing pencil sharpening devices which are suitable for circular or hexagonal cross-sections are usually constructed to require a rotational movement of blades around the axis of the pencil being sharpened. This type of mechanical action will not create the desired profile for a carpenter's pencil. As a consequence, the user is reduced to manually shaving or scrapping the carpenter's pencil to provide the desired profile.

A number of authors have suggested sharpening devices especially designed for pencils of rectangular or non-circular cross-sections. These are listed as follows:

| U.S. Pat. NO. | Inventor | Issue Date | Title |
|---|---|---|---|
| 4,081,010 | Galli | Mar. 28, 1978 | Pencil Sharpener for Non-circular Section Pencils |
| 4,759,129 | Alpha | Jul. 26, 1988 | Pencil Sharpener |
| 4,918,816 | Alpha | Apr. 24, 1990 | Pencil Sharpener |
| 4,961,451 | Bucci | Oct. 9, 1990 | Sharpener for Rectangular Pencils |
| 5,077,903 | Creim | Jan. 7,1992 | Carpenter's Pencil Sharpener |

The foregoing devices generally require rotary cutter assemblies which are mounted or manipulated so as to accommodate the irregular cross-section of the carpenter's pencil. They involve complicated and expensive mechanisms.

A commercial pencil sharpener for a carpenter's pencil is manufactured by Penshar LLC, which is manually rotated. However, this sharpener puts a conical end on the carpenter's pencil.

It would be desirable to have a sharpening device which will sharpen or shape wooden or similar non-metallic elongated objects having radially non-symmetrical cross-sections. It would also be desirable to have a low cost sharpening device especially adapted to sharpen a carpenter's pencil and provide a selected profile. It would also be desirable to have a low cost manually operated sharpening device for carpenter's pencils.

Accordingly, one object of the present invention is to provide a low cost sharpening or carpenter's pencils.

Another object of the invention is to provide a sharpening device for lead pencils of non-circular cross-sections or similar elongated objects which will sharpen or shape one end of the object to a desired profile.

SUMMARY OF THE INVENTION

Briefly stated the invention comprises apparatus for sharpening an elongated object so as to obtain a selected projected profile on one end of the elongated object, the elongated object having a uniform cross section along an object axis. The apparatus comprises a housing defining a recess having an opening and having a pair of convergent walls within the recess, a guide member slidably mounted on the housing on guide rails, the guide member defining a passage therethrough. The passage is shaped and dimensioned to receive the elongated object and to guide the object for longitudinal motion along the object axis between the convergent walls when manually actuated by a user, and at least one blade having a cutting edge and disposed on at least one of the opposed walls with the cutting edge extending into the recess, whereby the elongated object may be pushed through the passage of the guide toward the convergent walls while the elongated object is also being used to slide the guide member to move the end of the elongated object laterally back and forth past the cutting edges of the blades, so as to sharpen the elongated object to obtain the selected profile.

Preferably the apparatus is designed to sharpen a carpenter's pencil, and includes a duplicate set of recesses, convergent walls, guide members, and blades, one set accommodating the carpenter's pencil in one rotated position about its axis to shape the wide side, and the other set accommodating the carpenter's pencil in a different rotated position about its axis to shape the narrow side.

DRAWINGS

These and many other objects of the invention will be better understood by reference to the following description, taken in connection with the accompanying drawing, in which.

Figure 1:
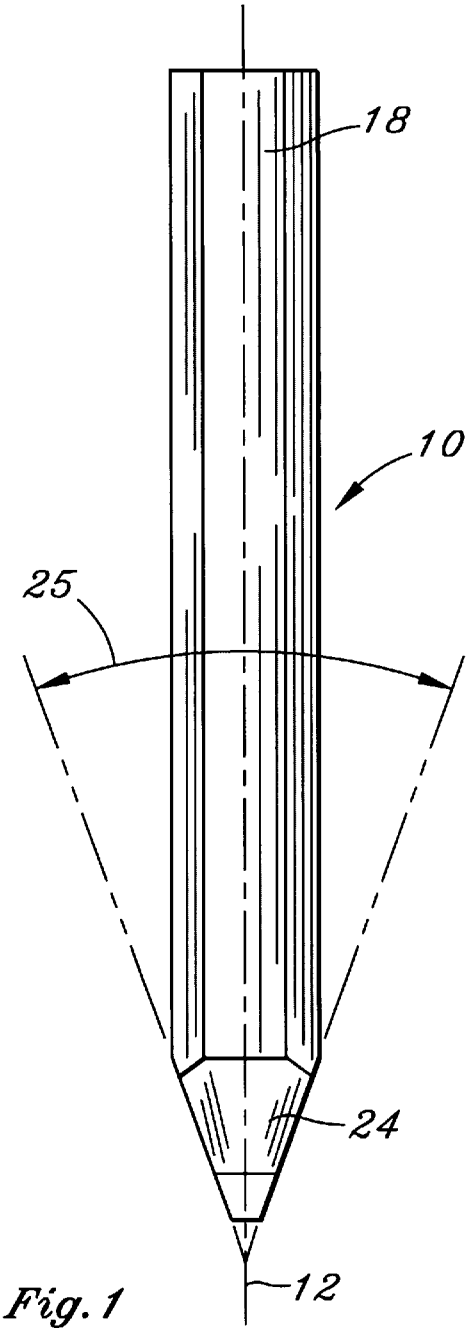
FIG. 1 is a front elevation view of a sharpened carpenter's pencil.
Figure 2:
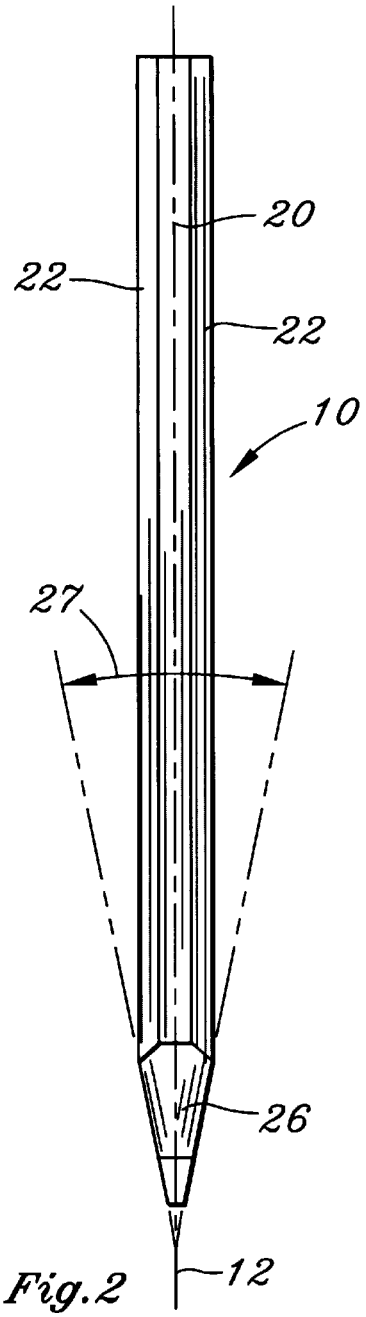
FIG. 2 is a side elevational view of the sharpened carpenter's pencil.
Figure 3:
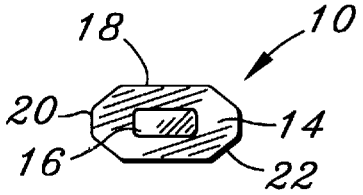
Figure 4:
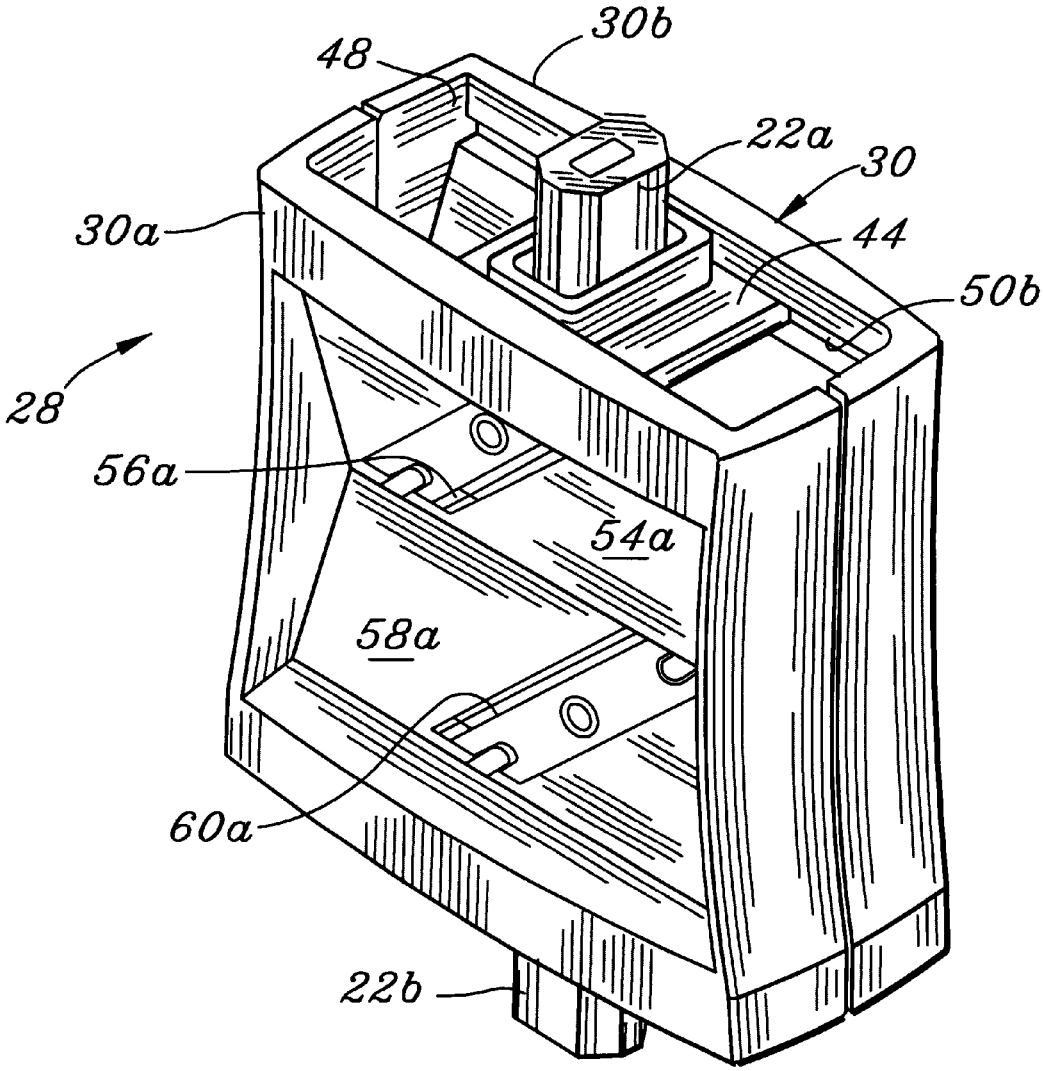
Figure 5:
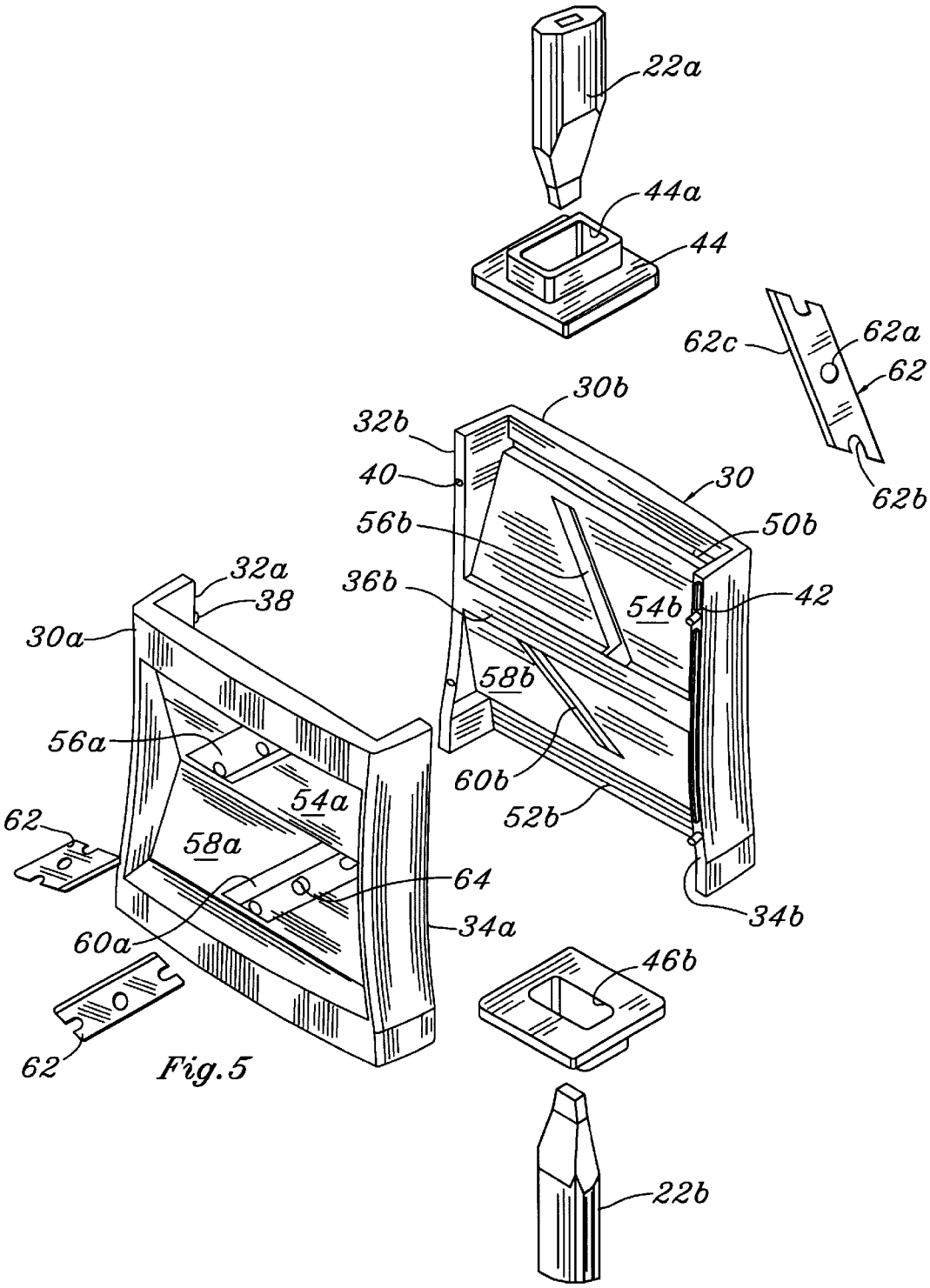
Figure 6:
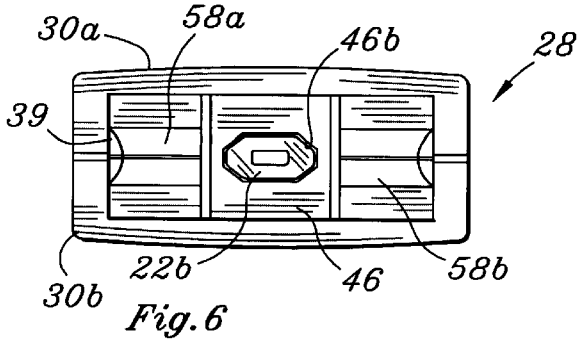
Figure 7:
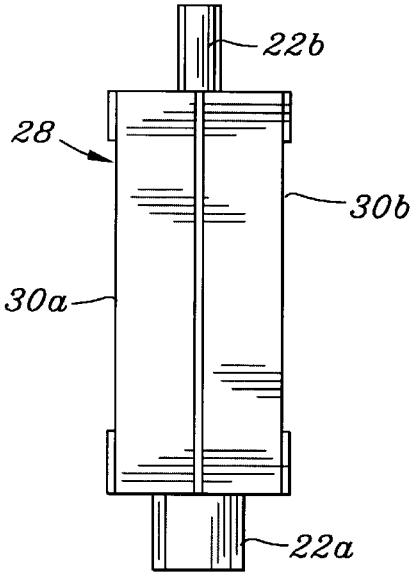
Figure 8:
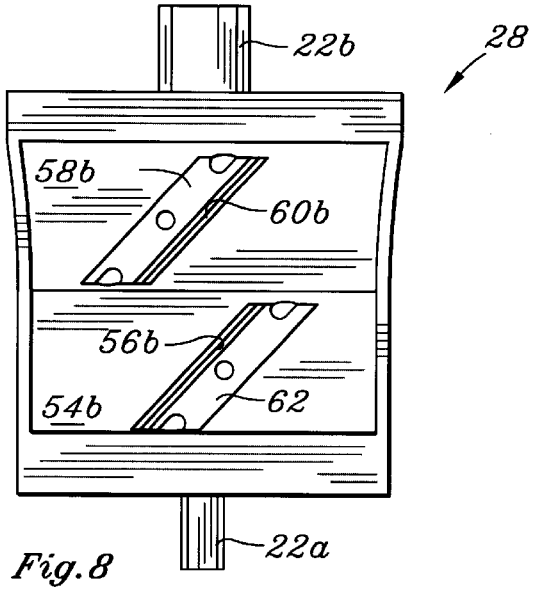
Figure 9:
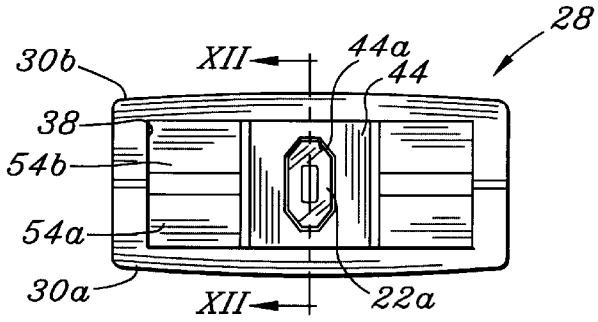
Figure 10:
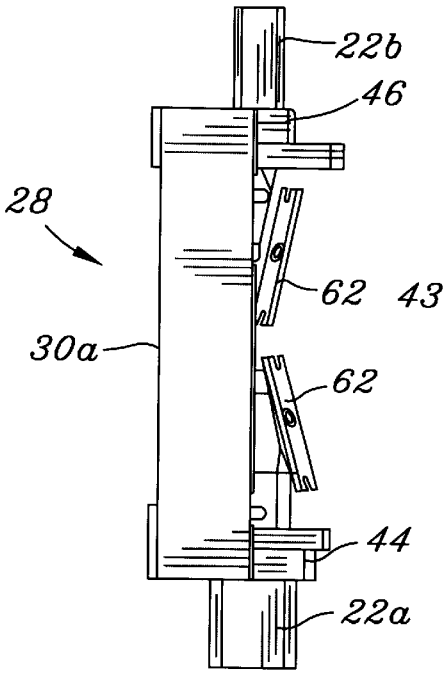
Figure 11:
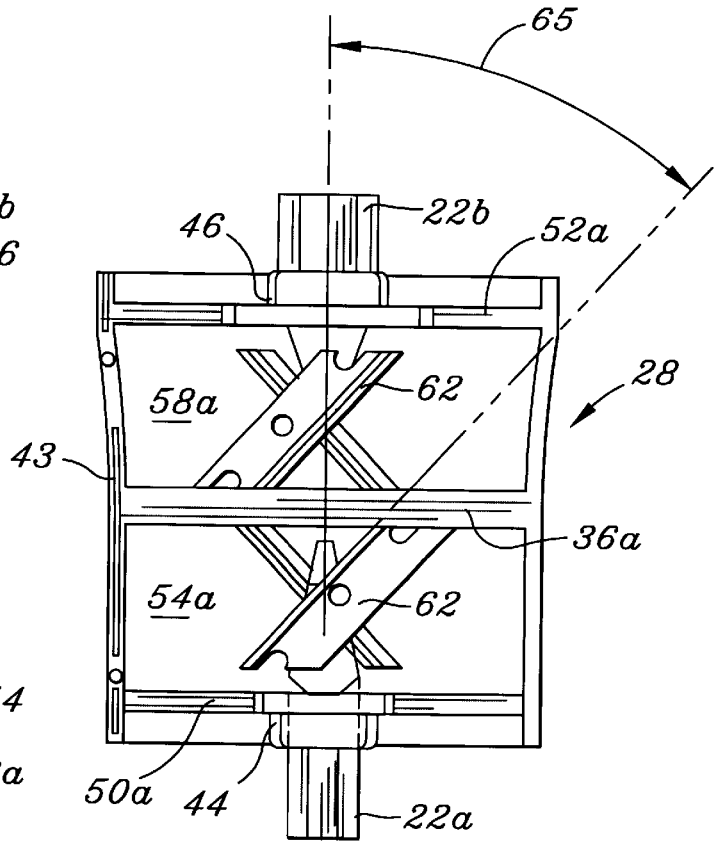
Figure 12:
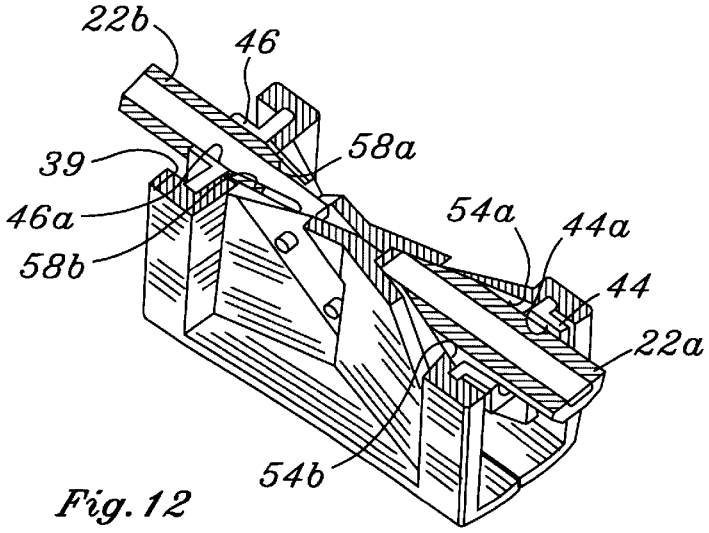

FIG. 3 is an enlarged top plan view of the carpenter's pencil of FIGS. 1 and 2, FIG. 4 is an isometric perspective drawing of the sharpening device in accordance with the present invention, showing portions of carpenter's pencils in the process of sharpening, FIG. 5 is an exploded view of the same isometric drawing of FIG. 4, illustrating the components of the sharpening device, FIG. 6 is a top plan view, FIG. 7 is a side elevation view, FIG. 8 is a front elevation view, FIG. 9 is a bottom plan view, FIG. 10 is a partial side elevation view corresponding to FIG. 7, but with one housing half removed, FIG. 11 is a front elevation view corresponding to FIG. 8, but with one housing half removed, and FIG. 12 is an isometric perspective view, taken in cross section along lines XII—XII of

DETAILED DESCRIPTION OF THE INVENTION

FIGS. 1, 2 and 3 illustrate a carpenter's pencil 10 sharpened on one end to achieve a selected profile. While the invention is primarily intended to provide a sharpened end on a carpenter's pencil the invention may be utilized with any elongated object of material capable of being sharpened with a blade and having a uniform cross section along an object axis 12. As shown in FIG. 3, the carpenter's pencil comprises a wooden sheath 14 around a lead core 16 of substantially rectangular cross section. As seen in FIG. 3, the carpenter's pencil 10 has a non-circular cross section with oppisitely disposed wide sides 18 and oppositely disposed narrow sides 20 separated by chamfered surfaces 22. The desired profile, viewed looking at the wide side in FIG. 1 is an isosceles trapezoid 24. The desired profile viewing the narrow side 20 in FIG. 2 is either a narrow isosceles trapezoid or an isosceles triangle 26.

Any desired included angle between the sides of trapezoid 24 may be selected. In the preferred embodiment, where the elongated object to be sharpened is a carpenter's pencil, the preferred included angle, indicated in FIG. 1 by reference number 25, is on the order of 34°. Also, any desired included angle between the sides of isosceles triangle 26 may be selected. In the preferred embodiment, where the elongated object to be sharpened is a carpenter's pencil, the preferred included angle indicated in FIG. 1 by reference number 27, is on the order of 24°.

Referring now to FIG. 4 of the drawing, the sharpener, shown generally as 28 includes a housing shown generally at 30, constructed as two substantially identical housing halves 30*a*, 30*b* preferably molded from a plastic material. Reference to the exploded view of FIG. 5 shows that the two halves 30*a*, 30*b* abut one another along vertical edges 32*a*, 32*b* and 34*a*, 34*b* respectively, and along central connecting ledges 36*a* (FIG. 11) and 36*b*. Matching locator pins and corresponding holes 40 align the two housing halves. A bead of plastic material 42 along the vertical edge 34*b* and a portion of the ledge 36*b*, together with a similar bead 43 (FIG. 11) on the other housing half, serve to join the two halves during final assembly by melting and then fusing when ultrasonic energy is applied through the plastic. Portions of a carpenter's pencil are shown in one rotated position about its axis as 22*a*, and in a different rotated position about its axis at 22*b*.

A guide member 44 with a passage 44*a* therethrough receives the carpenter's pencil 22*a*, which may slide along its axis in passage 44*a*. Similarly, a guide member 46 is located on the opposite end with a passage 46*b* therethrough. Passage 46*b* receives the carpenter's pencil 22*b* in a position rotated 90° about its axis, as should be apparent from the drawing. Guide members 44, 46 are also preferably of plastic material.

Sharpening device 28 is used in both of two orientations, depending upon which portion of the profile of pencil 22 is being sharpened. Therefore, there is no top nor bottom. FIGS. 4 and 5 are illustrated with the narrow end toward the top of the drawing, while FIGS. 6–11 are illustrated with the wide end toward the top of the drawing. It will be assumed in the following discussion that the wide end of the sharpening device is the "top" and that the narrow end is the "bottom", these being arbitrary designations, since the device is reversible and used in both positions during sharpening.

Referring to FIG. 4 of the drawing, the housing halves 30*a*, 30*b* together form an open recess 48 in the "bottom" of housing 30. Guide member 44 is disposed to move laterally in recess 48 along guide rails 50*a* (FIG. 11) and 50*b* formed in the respective housing halves 30*a*, 30*b*. Similarly, the guide member 46 is arranged to move laterally along guide rails 52*a* (FIG. 11) and 52*b*. A sloping wall 54*b* having a blade opening 56*b* therein extends from guide rail 50*b* to the central ledge 36*b*. A sloping wall 58*b* with a blade opening 60*b* therein extends from guide rail 52*b* to the central ledge 36*b*. On the opposite housing half 30*a* shown in FIG. 5, the back sides of corresponding walls 54*a*, 58*a* and blade openings 56*a*, 60*a* are shown. (See also FIG. 11)

A plurality of blades 62 with ventral holes 62*a* end notches 62*b* and cutting edges 62*c* are adapted to be disposed in the blade openings 56*a*, 56*b*, 60*a*, 60*b*. Blades 62 are substantially identical and are held in place by staking plastic pins such as 64, which are arranged to fit in the center holes 62*a* and end notches 62*b* to hold the blades permanently in place. The blades are oriented so that the blade edges 62*c* extend from the blade openings into the recesses beyond the inclined walls.

The cutting edges of the blades are oriented at a selected "cutting advance" angle with respect to the axis of the carpenter's pencil when it is inserted into guide 44 or 46. One blade on one of the convergent walls has its cutting edge facing in one direction, and the other blade on the facing wall has its cutting edge facing in the opposite direction. Material is removed from one side of the pencil as it moves laterally on one direction, and from the other side of the pencil as it moves laterally in the opposite direction. The cutting advance angle determines the amount of material removed for a given advance of the pencil along its axis into the recess. FIG. 11 illustrates at reference number the preferred cutting advance angle of 45°.

In addition to the orientation of the cutting edges with respect to the pencil axis, the blades are tilted in their mountings on the back sides of the convergent walls, so that the cutting edges extend through the blade openings 56*a*, 56*b*, 60*a* and 60*b* into the recess at an angle, termed the blade shave angle. A preferred blade shave angle is on the order of 20 and determines how much material is removed with each pass.

Reference now to FIGS. 6–11 illustrates the sharpening device 28 in a position which is inverted from that shown in FIGS. 4 and 5. In this manner, the elements which were not visible in the isometric views of FIGS. 4 and 5 may be seen.

FIG. 6 is a "top" plan view (inverted from the views shown in FIGS. 4 and 5). Here an open recess 39 at the "top" of the housing 30 is defined between the two housing halves 30*a*, 30*b*. The guide member 46 is arranged to move laterally in the recess 39 with respect to the axis of pencil 22*b*. The pencil may also slide axially along its axis through passage 46*b* toward the inclined walls 58*a*, 58*b*. Walls 58*a*, 58*b* are convergent toward one another.

Since the desired final profile of the pencil when sharpened in the device as illustrated in FIG. 6 will correspond to the pencil profile shown in FIG. 2, the selected included angle between the convergent walls 58*a*, 58*b* will be the same as angle 27 in FIG. 2.

FIG. 7 is a side elevational view, showing further details of the sharpening device.

FIG. 8 is a side elevational view showing the placement of blade openings 56*b*, 60*b* in the respective inclined walls 54*b*, 58*b*.

FIG. 9 is a "bottom" plan view. Recess 38 is defined between the housing halves 30*a*, before, with guide member 44 arranged to move laterally in recess 38. Walls 54*a*, 54*b* are convergent toward one another.

Since the desired final profile of the pencil when sharpened in the device as illustrated in FIG. 9 will correspond to the pencil profile shown in FIG. 1, the selected included angle between the convergent walls 58*a*, 58*b* will be the same as angle 25 in FIG. 1.

FIG. 10 is a side elevational view corresponding to FIG. 7, but with the housing half 30*b* removed to show the guide members 44, 46 and the orientation of blades 62.

FIG. 11 is a side elevational view corresponding to the side elevational view of FIG. 8, but with housing half 30*b* removed. Blades 62 have been left in place to show the orientation of the blades with respect to the inclined walls 54*a*, 58*a*. The blades are also arranged at angles with respect to the axes of the pencils so that material is shaved diagonally from the end of the pencil by the blade in one inclined wall as it moves in one lateral direction and is shaved diagonally from the other side of the pencil by the blade in the opposite convergent inclined wall as the pencil moves in the opposite lateral direction.

Operation

The perspective view in cross section of FIG. 12 illustrates more clearly the operation of the invention. One end of sharpening device 28 is used to create a sharpened profile in one rotated position of the pencil, while the opposite end of the sharpening device creates a selected profile when the pencil is rotated 90° about its axis. When the pencil is in position 22*a*, it is slid laterally back and forth in the guide member 44, advancing along its axis through passage 44*a* as material is removed from the narrow side 20 of the pencil. The edges of the blades extending from the convergent walls 54*a*, 54*b* remove material to create the selected profile as the pencil 22*a* is moved back and forth.

In a similar manner, when the pencil is in position shown in 22*b*, it is moved back and forth laterally in the guide member 46, advancing along its axis through passage 46*a* as material is removed from the wide side 18 of the pencil. The blade edges extending through the openings in convergent walls 58*a*, 58*b* shape the pencil to the desired selected profile.

Other modifications will occur to those skilled in the art, and it is desired to cover in the appended claims all such modifications as fall within the scope of the invention.

What is claimed is:

1. Apparatus for sharpening a carpenter's pencil having a wide side and a narrow side so as to obtain a selected profile on one end of the carpenter's pencil, said carpenter's pencil having an axis and a uniform cross section along said axis, said apparatus comprising:

a housing defining a first recess having a first opening and having a first pair of convergent walls facing one another within the recess, said housing also having first guide rails extending along said first opening, said housing also defining a second recess having a second opening and having a second pair of convergent walls facing one another within the second recess, said housing also having second guide rails extending along said second opening, a first guide member slidably mounted on said first guide rails, the first guide member defining a first passage therethrough, said first passage being shaped and dimensioned to receive said one end of the carpenter's pencil and to guide the carpenter's pencil for longitudinal motion along the axis with said wide side against the convergent walls when manually actuated by a user, a second guide member slidably mounted on said second guide rails, the second guide member defining a second passage therethrough, said second passage being shaped and dimensioned to receive said one end of the carpenter's pencil and to guide the carpenter's pencil for longitudinal motion along the axis with said narrow side against the second pair of convergent walls when manually actuated by a user, a plurality of blades, each blade having a cutting edge and disposed on one of said convergent walls with its cutting edge extending into one of the first and second recesses, whereby the carpenter's pencil may be pushed alternately through one of the first and second passages of the respective first and second guide members toward the convergent walls while the carpenter's pencil is also being used to slide a first or second guide member to move the end of the carpenter's pencil laterally against the cutting edges of said blades, so as to sharpen the carpenter's pencil to obtain the selected profile.

2. The combination according to claim 1, wherein the first and second passages in the first and second guide members are dimensioned to receive the carpenter's pencil in either of two positions rotated 90° about the axis, and wherein the first pair of convergent walls define a first included angle therebetween, and wherein the second pair of convergent walls define a second included angle therebetween; whereby the profile on the end of the carpenter's pencil may be shaped at the first included angle in one rotated position about the axis using the first guide member and shaped at the second included angle in a 9020 rotated position about the axis using the second guide member.

3. The combination according to claim 2, wherein said first included angle is on the order of 24°.

4. The combination according to claim 2, wherein said second included angle is on the order of 34°.

5. The combination according to claim 1, wherein said housing is constructed as two substantially identical housing halves.

* * * * *

UNITED STATES PATENT AND TRADEMARK OFFICE

CERTIFICATE OF CORRECTION

PATENT NO. : 6,725,549 B2
DATED : April 27, 2004
INVENTOR(S) : Arnim B. Jebe and Joseph A. Naim It is certified that error appears in the above-identified patent and that said Letters Patent is hereby corrected as shown below:

Column 6,
Line 44, delete "9020" and insert -- 90° --

Signed and Sealed this

Twenty-seventh Day of July, 2004

JON W. DUDAS
*Acting Director of the United States Patent and Trademark Office*